US006004408A

United States Patent [19]

Montagnon

[11] Patent Number: 6,004,408

[45] Date of Patent: Dec. 21, 1999

[54] NICKEL-CHROME-IRON BASED ALLOY COMPOSITION

[75] Inventor: Jacques Montagnon, Clermont Ferrand, France

[73] Assignee: Aubert & Duval (société anonyme), France

[21] Appl. No.: 08/976,070

[22] Filed: Nov. 21, 1997

[51] Int. Cl.[6] ..... C22C 19/05

[52] U.S. Cl. ..... 148/410; 420/444; 420/451; 420/448

[58] Field of Search ..... 420/444, 451, 420/448, 453, 410

[56] References Cited

U.S. PATENT DOCUMENTS 5,556,594 9/1996 Frank et al. ..... 420/448

*Primary Examiner*—Deborah Yee
*Attorney, Agent, or Firm*—Londa and Traub LLP

[57] ABSTRACT

The invention relates to precipitation hardened alloy compositions comprising the following elements, with the contents expressed in % by weight:

| | |
|---|---|
| nickel: | ≧52.00% |
| chromium: | 20.50%–22.50% |
| iron: | 7.00%–13.00% |
| molybdenum: | 5.50%–7.0% |

-continued

| | |
|---|---|
| copper: | 1.00%–3.50% |
| niobium: | 2.65%–3.50% |
| titanium: | 1.0%–2.0% |
| cobalt: | 0–3.00% |
| aluminum: | 0–0.75% |
| tungsten: | 0–0.50% |
| silicon: | 0–0.20% |
| manganese: | 0–0.20% |
| phosphorous: | 0–0.03% |
| carbon: | 0–0.02% |
| nitrogen: | 0–0.02% |
| magnesium: | 0–0.005% |
| sulfur: | 0–0.005% |

the elements satisfying the following four relationships:

X=(2.271% Ti+1.142% Cr+0.957% Mn+0.858% Fe+0.777% Co+0.717% Ni+2.117% Nb+1.550% Mo+1.655% W+1.90% Al+1.90% Si+0.615% Cu)≦93.5, the percentages for this relationship being in atomic %;

Y=(% Mo+% W+% Cu)≦9, the percentages for this relationship being in % by weight;

A=(0.65% Nb+1.25% Ti+2.20% Al)≧4.4, the percentages for this relationship being in % by weight;

$$B = \left(\frac{1.25\%\ Ti + 2.20\%\ Al}{0.65\%\ Nb}\right) \geq 0.80,$$

the percentages for this relationship being in % by weight. The invention also relates to a process for transforming this alloy and to very large pieces of up to several tonnes for the oil industry.

10 Claims, No Drawings

NICKEL-CHROME-IRON BASED ALLOY COMPOSITION

FIELD OF THE INVENTION

The invention relates to a precipitation hardened Ni-Cr-Fe based alloy composition with good mechanical characteristics up to 500° C., also good resistance to different types of corrosion and hydrogen embrittlement. This novel alloy is specially adapted to die forging very large pieces of up to several tonnes (i.e. metric tons), for very deep oil and gas wells, including offshore wells.

The tables and text in the present application use the following abbreviations:

$R_m$=maximum strength $R_{p0.2}$=conventional 0.2% yield strength $E_{5d,4d}$=% elongation over 4d and 5d bases (d=test piece diameter)

Z=necking

RCH=Rockwell hardness

E=elongation $\epsilon$=strain rate $L/L_0$=degree of drawing; $L_0$ is the undrawn length and L is the drawn length;

KV=impact bending energy at break using a test piece with a V notch $HV_{30}$=Vickers hardness at 30 kg load.

TECHNOLOGICAL BACKGROUND

Continuous exploitation of fossil energy, gas and oil, has led to a demand for materials which have both high corrosion resistance and sufficient mechanical strength to stand up to the conditions they encounter, but also which are very malleable so that they can be easily transformed using existing techniques to produce pieces which may have complex shapes which necessitate handling several tonnes of these materials, for example "Christmas trees" or offshore well heads, pump bodies, or valves.

The types of corrosion encountered in the fossil energy extraction field, can be classified into three categories: the first, into which the majority of cases fall, being corrosion by $CO_2$ gas; the second, which is quite frequent, being corrosion by a combination of $CO_2$ and $H_2S$ gases; and the third class of corrosive environments, which is still in the minority since it is encountered in deep wells, being corrosion by simultaneous concentrations of highly aggressive substances $H_2S$, $CO_2$, and chloride salts mixed with water, methane, and hydrocarbons. These hydrocarbons can sometimes be in a minor proportion in extracted mixtures which are rendered highly acidic by the presence of $H_2S$ and its chemical reactions.

The increase in pressure and temperature with depth renders these environments even more aggressive against metallic materials: deep wells drilled onshore and offshore in northern USA, in Europe, and in Australia, for example, have experienced high rates of corrosion and premature breakage of ordinary metallic materials. Offshore drilling adds to that the external corrosion of pieces by seawater.

The combination of such very severe conditions means that the materials used must have very good resistance to corrosion in all of its forms. However, generalised corrosion resistance is relatively easy to obtain, and it is necessary to ensure that precautions are taken against localised corrosion, stress corrosion in chloride environments, and against hydrogen embrittlement. Although the oil industry has few corrosion problems in terms of frequency, it encounters just the specific problems described above during offshore production, combined with difficulties in overcoming or evaluating actual deaeration of hot corrosive environments, which are highly acidic and under pressure, and which can lead to stress corrosion cracking (SCC) of usual alloys such as stainless steels. Stress corrosion must be distinguished from hydrogen embrittlement which is connected with the presence of $H_2S$, although those two mechanisms can occur simultaneously.

Among metallic materials, alloys based on Ni—Cr systems and Ni—Fe—Cr systems are used under such conditions because of the excellent compromise they offer between corrosion resistance and cost compared with other, more costly materials such as titanium. Ni—Cr based alloys with a high nickel content are known to be sensitive to hydrogen, and the severe conditions described above thus direct the choice to Ni—Fe—Cr alloys which have a high iron content which also limits materials costs.

Ni—Fe alloys with nickel contents of over about 40% by weight can be protected against stress corrosion in chloride environments in limited circumstances which depend on complementary additions, in particular of the elements chromium, molybdenum and copper.

In general, nickel based alloys containing the elements Mo, Cu and Fe are suitable for non oxidising corrosive environments, in particular non aerated environments: the synergistic effect of molybdenum and copper is recognised for countering corrosion in reducing acidic environments which are rich in chlorides, the effect of the molybdenum being preponderant.

However, in the most severe oil industry environments described above, which can be partially, temporarily, or even accidentally, oxidising or aerated, chromium, an element which resists oxidation makes an essential contribution to the corrosion resistance of Ni—Fe—Cr—Mo—Cu alloys.

The molybdenum content has a marked effect on alloys containing at least 40% of nickel and 20% of chromium, as regards stress corrosion in oil industry environments containing $CO_2$, $H_2S$, $Cl^-$ and elemental sulfur. Three important criteria can be distinguished in these environments: temperature, acidity, and chloride concentration. In particular, increasing the molybdenum content can increase the maximum service temperature above which stress corrosion occurs.

Similarly, raising the molybdenum content means that higher acidity and higher chloride concentrations can be tolerated, with due allowance being made for localised corrosion of Ni—Fe—Cr—Mo—Cu alloys.

With the aim of satisfying the demand for good mechanical characteristics and creep strength, Ni—Fe—Cr based alloys exist which are precipitation hardened by precipitation of phases which confer high strength while ductility remains good. In the majority of these alloys, used in particular in the aircraft industry in the hot zones in engines or in turbines, the elements niobium, titanium, and aluminum, in suitable proportions, participate in hardening reactions by which the alloy attains its hardness during an aging treatment carried out in a temperature range where those addition elements are supersaturated in the austenitic matrix, which has previously been homogenised at a higher temperature, and which then becomes a metastable solution.

French patents FR-A-2 154 871 and FR-A-2 277 901 indicate that elements Al, Ti and Nb which are supersaturated in austenite form intermetallic compounds with nickel which produce the desired hardening, of which there are two types. Aluminum causes the formation of a face centered cubic phase with crystallographic structure $L_{12}$ with an $A_3B$ type chemical composition where A represents nickel and a small fraction of the other elements of the austenitic matrix (iron, cobalt, chromium, . . .) and B represents aluminum; that phase is termed the γ' phase. Titanium can substitute all or part of the aluminum in the γ' phase and can increase its hardening effect at higher temperatures.

Niobium causes the formation of an intermetallic phase with a $Do_{22}$ type centred tetragonal structure, also with a composition $A_3B$ where this time B represents niobium, the phase being termed the γ" phase.

Such alloys are hardened by precipitation of one or other of those phases, or both at once, between 600° C. and 800° C., which constitutes an improvement claimed in FR-A-2 154 871 which is applied to Ni—Fe—Cr based alloys comprising 15% to 25% by weight of iron, 15% to 25% of chromium, 2.5% to 9% of molybdenum, 1.5% to 6.5% of niobium and/or tantalum, 0.5% to 1.5% of titanium, 0.3% to 1.5% of aluminum and 0.03% to 0.2% of carbon. The alloys claimed in that patent are characterized by very precise titanium, aluminum, and niobium (+tantalum) contents, such that their sum in atomic % must be in the range 4% to 6% and such that the (Ti+AI)/(Nb+Ta) ratio of the sums in atomic % is over 0.8, with the precise aims firstly of obtaining good precipitation hardening during an aging cycle carried out in two temperature stages, and secondly of suppressing the overaging effect which occurs in such alloys during high temperature service, and finally to provide good ductility both at room temperature and when hot, for example in creep.

The invention described in FR-A-2 154 871 is based on the following discovery: the claimed properties are due to a particular and very stable morphology of the γ' and γ" precipitates in which the six faces of the cubic γ' phase precipitates formed during the highest temperature aging stage are covered with precipitates of platelets of the γ" phase formed during the second temperature stage, at a lower temperature than the first.

According to that invention, simultaneous precipitation of carbides in the grain boundaries can further increase the strength at high service temperatures.

European patent EP-A-0 262 673 claims a precipitation hardened nickel based alloy which is resistant to hydrogen embrittlement and to corrosion in chloride media containing $H_2S$. That alloy contains 15% to 25% by weight of Cr, 5% to 28% of Fe, 6% to 9% of Mo, 2.5% to 5% of Nb, 0.5% to 2.5% of Ti, up to 0.5% of Al and 54% to 64% of Ni: the claims are directed towards applications in oil industry environments. Supplementary conditions give more precise values for the alloying element contents. The alloys described in EP-A-0 262 673 do not include the addition of copper, or copper addition is limited to less than 1%, but they can be hardened by precipitation of two phases: γ' then γ".

EP-A-0 247 577 claims another nickel based alloy which is precipitation hardened by γ' and γ" phases and which is resistant to corrosion in media containing $H_2S$ and $Cl^-$ at high temperatures; that alloy contains 16% to 24% of chromium, 7% to 12% of molybdenum, less than 4% of tungsten, 2% to 6% of niobium, less than 1% of aluminum, 0.5% to 2.5% of titanium, 0 to 3% of copper, less than 20% of iron, more than 55% of nickel and controlled amounts of carbon, cobalt, silicon, manganese, boron, zirconium, nitrogen, phosphorous and sulfur. Further, the sum (Cr+Mo) is limited to 31% by weight while the sum of the atomic percentages of elements Nb, Ti and Al is kept between 3.5% and 5%.

All of the alloys described in the patents referred to above, in addition to high strength and good corrosion resistance, are easy to work and are insensitive to precipitation of harmful intermetallic phases.

However, manufacturers of pieces from such alloys and from super-alloys in general, whether involved in smelting, forging, or using heat treatment units, encounter insurmountable problems with ingots and semi-finished products weighing several tonnes and with large cross sections.

Typically forging produces pieces by thermo-mechanical transformation of ingots: for nickel based alloys containing the elements titanium, aluminum, or chromium, which have a high affinity for oxygen, ingots are produced in two steps. The first step is the production of electrodes under vacuum and the second step is one or more remelting steps using electrodes using vacuum arc remelting (VAR) or electroslag remelting (ESR). Those two remelting processes affect the quality of the metals by completing primary production (complementary purification and improving inclusion cleanliness); they also affect solidification control by reducing defects and minimising segregation of the alloying elements.

The ESR process currently results in better desulfuration, and is used especially for the production of large ingots where it is irreplaceable. Controlling the remelting parameters can produce the best structural homogeneity in the ingots.

However, as the quantity of alloying elements which are prone to segregation increases, and when the size of the remelted ingots increases, which is possible nowadays with furnaces with ever larger diameters, the risk of defects on solidification grows: defects which can occur in remelted ingots are listed in American Standard Test Method ASTM A604.

There is an absolute limit on the size of a remelted ingot for a given alloy and once the remelting parameters have been optimised, above which the degree of segregation is such that the properties in service can no longer be guaranteed at all points in its volume. The hardening elements titanium, aluminum, and niobium are known to be very limiting as regards the maximum diameter of ingots if a no-defect situation is desired.

In extreme cases, once solidification has finished, segregation of alloying elements generally causes the formation of particular eutectoid or eutectic compositions the nature of which depend on the segregated elements: niobium forms Laves phases with iron ($Fe_2Nb$), in which silicon is concentrated; molybdenum produces a p phase ($Ni_7Mo_6$) with nickel, and the sigma phase with chromium and iron, while titanium and aluminum produce massive $Ni_3(Ti,Al)$ type eutectic compositions. Further, all of those elements can form nitrides, carbides, or borides in the presence of nitrogen, carbon, and boron respectively.

Such compositions are harmful since they produce heterogeneous properties in the alloy and fix the alloying elements in the service and forging temperature ranges. Further, the majority have low melting points, which limits the homogenisation and forging temperatures of the ingots.

A further very constricting phenomenon of too much addition of elements titanium, aluminum, niobium, and molybdenum is heat hardening of a solid solution (Mo, W, Nb) or premature precipitation hardening of secondary phases (Ti, Al) which increases as the temperature falls: such hardening effects are such that thermo-mechanical transformation operations require energy which is not available with existing tools in the case of large ingots. This phenomenon limits the forging range to a minimum temperature below which the metal is too hard.

Increasing the addition of alloying elements thus has the effect of reducing the range over which alloys can be subjected to thermo-mechanical transformation, both at low temperatures and at high temperatures.

Finally, when alloys require solution heat treatment and rapid quenching followed by age hardening by precipitation of secondary phases, the size of pieces is again limited, and above that size the rate of cooling during rapid quenching is insufficient at the core of the piece to avoid the onset of coarse and disordered precipitation of the hardening phases: the addition of more alloying elements, which accentuates matrix supersaturation, accelerates precipitation kinetics which are thus out of control and thereby reduces the maximum size of pieces that can be treated.

SUMMARY OF THE INVENTION

In order to overcome such very difficult problems and allow easy working of die forged pieces weighing several tonnes, while retaining the desired properties, the inventors have developed novel precipitation hardened Ni—Cr—Fe alloy compositions where all of the elements are linked by restrictive formulae so as to obtain:

- ingots with low segregation, including those with a mass of at least 8 tonnes;
- a wide range of homogenisation temperatures, extending up to 1250° C.;
- a wide range of thermo-mechanical transformation temperatures, in which the material can easily be worked by forging, drop forging, and rolling using normal existing tools;
- controlled supersaturation of the alloying elements in the dissolved matrix, to retain a metastable austenite which can be age hardened, including in the cores of massive pieces;
- combining high hardness, of over 34 RCH after treatment, with a high yield strength ($R_{p0.2} \geqq 700$ N/mm$^2$) and good ductility ($E_{4d} \geqq 20\%$), even in the core of large pieces;
- good resistance to the various types of corrosion encountered in oil environments.

The essential elements in this nickel based alloy are chromium, molybdenum, niobium, titanium, aluminum and copper, iron being the make-up as that element is less expensive and helps to limit sensitivity to hydrogen embrittlement in Ni—Cr alloys.

The broadest composition ranges claimed are, in percentages by weight:

| | |
|---|---|
| Aluminum | ≦0.75 |
| Carbon | ≦0.020 |
| Niobium | 2.65–3.50 |
| Cobalt | ≦3.0 |
| Chromium | 20.5–22.5 |
| Copper | 1.0–3.5 |
| Iron | 7.0–13.0 |
| Magnesium | ≦0.0050 |
| Manganese | ≦0.20 |
| Molybdenum | 5.50–7.0 |
| Nitrogen | ≦0.020 |
| Nickel | ≧52.0 |
| Phosphorous | ≦0.030 |
| Sulfur | ≦0.0050 |

-continued

| | |
|---|---|
| Silicon | ≦0.20 |
| Titanium | 1.0–2.0 |
| Tungsten | ≦0.50 |

Further, the claimed alloy compositions must satisfy the following relationships in order to guarantee all of the desired properties:

X=[2.271% Ti+1.142% Cr+0.957% Mn+0.858% Fe+0.777% Co+0.717% Ni+2.117% Nb+1.550% Mo+1.655% W+1.90% Al+1.90% Si+0.615% Cu] ≦93.5, in atomic %;

Y=(% Mo+% W+% Cu)≦9, in % by weight;

A=(0.65% Nb+1.25% Ti+2.20% Al)≧4.4, in % by weight; and $$\bullet\ B = \left(\frac{1.25\%\ Ti + 2.20\%\ Al}{0.65\%\ Nb}\right) \geq 0.80, \text{ in \% by weight}$$

in % by weight.

DETAILED DESCRIPTION OF THE INVENTION

The role of each of the elements in the alloy is explained along with the reasons leading to defining the above relationships, and also the limits on the contents of each of the controlled elements.

In contrast to FR-A-2 154 871, which claims nickel based alloys comprising 0.03% to 0.2% of carbon to improve mechanical behaviour at high temperature, in particular creep behaviour, the alloy of the present invention for low temperature applications (<400° C.) claims a very low carbon content for applications where corrosion resistance is paramount, for the following reasons. Carbon has a high tendency to segregate during solidification of nickel based alloys, in which this element is poorly soluble even at concentrations as low as 0.03%; in the presence of carbide-forming elements such as niobium, titanium, or molybdenum, which also have a tendency to segregate, carbon forms massive carbides in eutectic clusters, in the interdendritic regions at the end of solidification. These clusters of segregated carbides are extremely harmful from a variety of aspects. In ingots, because of their low melting point, they cause constitutional melting on reheating before homogenisation or forging at temperatures well below the solidus of the alloy, which means that effective homogenisation treatments for the metallic addition elements cannot be used, and they are a source of cracks during high temperature thermo-mechanical transformations. Further, pieces are found to contain aligned carbides which contribute to structural heterogeneities and which constitute weak points, in particular as regards corrosion resistance.

Finally, carbon is well known to be extremely harmful, regarding intergranular corrosion resistance of steels and alloys aged between 600° C. and about 900° C., since it fixes chromium and molybdenum in $M_{23}C_6$ or $M_6C$ carbides, thereby depleting grain boundaries in these two elements which are essential to corrosion resistance, and it also weakens precipitation hardening of $\gamma'Ni_3(Al,Ti)$ and $\gamma''Ni_3Nb$ phases since, in this case also, carbon fixes the essential elements titanium and niobium in stable carbides over a wide temperature range.

For these reasons, the carbon content in the claimed alloy is limited to 0.02%, and preferably to less than 0.015%.

The very precise proportions of the addition elements titanium, aluminum, and niobium ensure the desired hardening by a solution treatment followed by double aging in two temperature stages which precipitate the γ' and the γ" phases in succession. Calculation of the degree of precipitation of the hardening phases has allowed us to adjust the titanium, aluminum, and niobium contents. In order to obtain a room temperature yield strength of 700 N/mm$^2$ or more, the following relationships have been defined:

$$A=(0.65\%\ \text{Nb}+1.25\%\ \text{Ti}+2.20\%\ \text{Al})\geqq 4.4\%\ \text{by weight, and}$$

$$B=\frac{(1.25\%\ Ti+2.20\%\ Al)}{0.65\%\ Nb}\geq 0.80\%\ \text{by weight}$$

The metal is hardened after solution treatment and rapid quenching by a two-stage double aging treatment, the first stage at a temperature in the range 700° C. to 760° C. for first rapid hardening in less than 8 hours by precipitation of a first phase γ' $Ni_3(Ti,Al)$ while the second stage, at a lower temperature, typically 600° C. to 675° C., ensures complementary hardening by precipitation of the γ" $Ni_3Nb$ phase on the γ" phase seeds.

Aluminum, which causes a very rapid hardening reaction, is not suitable for treating large pieces in which the heating and cooling kinetics are necessarily slow since disordered precipitation of $Ni_3Al$ could commence during rapid quenching after solution treatment, or overaging could occur during the first hardening stage. For this reason, hardening with titanium is preferred, the aluminum content being limited to 0.75%, preferably in the range 0.4% to 0.6%. Further, hardening in the first stage only becomes appreciable with the addition of titanium, as we demonstrate in the examples.

TABLE 1

Characteristics of test castings

| Castings | A | B | C | D | E | F | G | H | I | J | K |
|---|---|---|---|---|---|---|---|---|---|---|---|
| Ingot weight | 35 kg | 35 kg | 35 kg | 35 kg | 35 kg | 35 kg | 1 tonne | 1 tonne | 8 tonnes | 8 tonnes | 8 tonnes |
| Production process | VIM | VIM | VIM | VIM | VIM | VIM | VIM + ESR | VIM + ESR | VIM + ESR | VIM + ESR | VIM + ESR |
| Carbon (wt %) | 0.005 | 0.006 | 0.008 | 0.005 | 0.0037 | 0.0037 | 0.015 | 0.0088 | 0.0064 | 0.017 | 0.015 |
| Silicon (wt %) | <0.10 | <0.10 | <0.10 | <0.10 | <0.10 | <0.10 | <0.10 | <0.10 | <0.10 | <0.10 | <0.10 |
| Manganese (wt %) | <0.02 | <0.02 | <0.02 | <0.02 | <0.02 | <0.02 | 0.023 | <0.02 | <0.02 | <0.02 | <0.02 |
| Sulfur (wt %) | 0.0010 | 0.0010 | 0.0011 | 0.0014 | 0.0010 | 0.0009 | 0.00017 | 0.00013 | 0.00016 | 0.00021 | 0.00036 |
| Phosphorous (wt %) | <0.003 | <0.003 | <0.003 | <0.003 | <0.003 | 0.003 | 0.013 | 0.0054 | <0.003 | <0.003 | <0.003 |
| Nickel (wt %) | 53.1 | 52.4 | 52.6 | 52.5 | 58.5 | 55.5 | 55 | 52.9 | 54.7 | 54.3 | 54.4 |
| Chromium (wt %) | 21.54 | 21.35 | 21.43 | 21.22 | 21.41 | 21.10 | 21.70 | 21.74 | 21.96 | 21.55 | 21.28 |
| Molybdenum (wt %) | 5.52 | 5.51 | 5.53 | 5.53 | 5.64 | 6.53 | 5.77 | 6.63 | 5.92 | 6.62 | 6.59 |
| Aluminum (wt %) | 0.75 | 0.80 | 0.50 | 0.47 | 0.52 | 0.52 | 0.45 | 0.43 | 0.43 | 0.49 | 0.47 |
| Cobalt (wt %) | <0.02 | <0.02 | <0.02 | <0.02 | <0.02 | <0.02 | <0.02 | <0.02 | <0.02 | <0.02 | <0.02 |
| Copper (wt %) | 1.17 | 1.18 | 1.15 | 1.21 | 1.32 | 3.96 | 1.30 | 1.33 | 1.36 | 1.43 | 1.40 |
| Titanium (wt %) | 2.72 | 1.98 | 1.25 | 0.76 | 1.47 | 1.20 | 1.58 | 1.40 | 1.56 | 1.41 | 1.36 |
| Iron (wt %) | 14.50 | 15.50 | 14.50 | 14.50 | 5.85 | 8.06 | 11.22 | 12.58 | 11.11 | 11.01 | 11.25 |
| Niobium (wt %) | 0.65 | 1 .20 | 2.97 | 3.74 | 2.81 | 3.03 | 2.78 | 2.65 | 2.88 | 3.08 | 2.79 |
| Tungsten (wt %) | <0.10 | <0.10 | <0.10 | <0.10 | 2.58 | <0.10 | <0.10 | <0.10 | <0.10 | <0.10 | <0.10 |
| Nitrogen (wt %) | — | — | — | — | — | — | 0.0083 | 0.00057 | 0.00074 | 0.0033 | 0.00088 |
| Oxygen (wt %) | — | — | — | — | — | — | 0.0018 | 0.0024 | 0.00087 | 0.0017 | 0.00050 |
| Relationships | | | | | | | | | | | |
| X (atomic %) | 94.0 | 93.3 | 92.9 | 92.6 | 93.2 | 92.2 | 92.9 | 93.2 | 93.2 | 93.4 | 92.9 |
| Y (wt %) | 6.69 | 6.69 | 6.68 | 6.74 | 9.54 | 10.49 | 7.07 | 7.96 | 7.28 | 8.05 | 7.99 |
| A (wt %) | 5.47 | 5.01 | 4.59 | 4.41 | 4.81 | 4.60 | 4.77 | 4.41 | 4.77 | 4.84 | 4.55 |
| B (wt %) | 11.95 | 5.43 | 1.38 | 0.82 | 1.63 | 1.34 | 1.64 | 1.57 | 1.55 | 1.42 | 1.51 |

VIM: Vacuum induced melting
ESR: Electro Slag Remelting

Castings A to F were not in accordance with the present invention and are used as comparative examples throughout the present application.

Castings G, H, I, J and K were in accordance with the present invention. So far as the inventors are aware, casting I constitutes the best mode of producing the alloy composition of the invention.

Castings A, B and C, the characteristics of which are shown in Table 1, were produced under vacuum. With the aim of illustrating the invention, they showed the fundamental hardening effect of titanium. To this end, $HV_{30}$ hardness measurements were made after different aging processes. The results obtained are shown in Table 2 below.

TABLE 2

Aging response for castings A, B and C forged then solution treated and rapidly quenched

| Aging (temperature/ time at temperature) | Castings (solution treatment) A (1050° C./ 2 h/water) (Hardness $HV_{30}$) | B (1020° C./ 2 h/water) (Hardness $HV_{30}$) | C (1000° C./ 2 h/water) (Hardness $HV_{30}$) |
|---|---|---|---|
| 650° C./5 h | 240 | 245 | 230 |
| 650° C./10 h | 260 | 250 | 250 |
| 650° C./20 h | 275 | 255 | 247 |
| 700° C./15 h | 280 | 280 | 278 |
| 700° C./10 h | 305 | 285 | 280 |
| 700° C./20 h | 310 | 290 | 287 |

TABLE 2-continued

Aging response for castings A, B and C forged then solution treated and rapidly quenched

| Aging (temperature/ time at temperature) | Castings (solution treatment) A (1050° C./ 2 h/water) (Hardness $HV_{30}$) | B (1020° C./ 2 h/water) (Hardness $HV_{30}$) | C (1000° C./ 2 h/water) (Hardness $HV_{30}$) |
|---|---|---|---|
| 750° C./5 h | 315 | 320 | 317 |
| 750° C./10 h | 355 | 315 | 304 |
| 750° C./20 h | 350 | 320 | 305 |
| 800° C./5 h | 335 | 308 | 305 |
| 800° C./10 h | 330 | 300 | 290 |
| 800° C./20 h | 342 | 310 | 277 |

It can be seen that, despite the inversely proportional increase of niobium with decreasing titanium content, the high titanium castings hardened substantially during simple aging limited to industrially practical periods (<1 day) through the whole temperature range which was in the range 650° C. to 800° C.

However, the increase in the titanium content gradually leads to poor performance as shown by the tests carried out on bars forged from castings A to E, the results of which are shown in Table 3 below.

which is deleterious during aging treatment which encourages intergranular reprecipitation of harmful carbides of chromium and molybdenum.

Metal hardening is more and more rapid on cooling from the upper range of solution treatment temperatures, as shown by the final hardness measured on as forged bars from castings A to E which include a variety of titanium contents: castings which are richest in titanium start to harden during the forging operations, as shown by their increased hardness which is more heterogeneous through the volume of the products.

In order to contain this rapid and expected hardening effect within acceptable limits during anisothermal thermo-mechanical transformations, which causes great deformation difficulties, or during rapid quenching of massive pieces, which risks causing quenching cracks in the pieces and disordered hardening, the claimed titanium content in the alloy is limited to 2%.

Niobium is the element which allows complementary hardening of the claimed alloy: with less than 2% of titanium (castings B and C), Table 2 shows that the desired hardness (>320 $HV_{30}$) can not be regularly reached by precipitation of only the γ' phase between 700° C. and 760° C. Addition of niobium such that

TABLE 3

Characteristics of square section bars forged from test castings A, B, C, D and E

| Products/ Condition | Characteristic measured | Castings tested A | B | C | D | E |
|---|---|---|---|---|---|---|
| 17 × 17 mm as forged | Hardness $HV_{30}$ | 410 | 310 | 295 | not forged | not forged |
| 45 × 45 mm as forged | | 222 | 214 | 210 | 223 (cracks) | 215 (cracks) |
| 17 × 17 mm annealed 950° C./1 h | Hardness | 310 | 260 | 200 | — | — |
| | Impact bending KV (J) | 25 | 55 | >294 | — | — |
| | Precipitation structure | $Ni_3Ti$ abundant and generalised | $Ni_3Ti$ inter-granular | Rare $Ni_3Ti$ | | |
| Precipitate dissolution range | Solvus temperature (° C.) | 1040–1060 | 1000–1020 | 980–1000 | — | — |
| | Hardness $HV_{30}$ | 160 | 175 | 190 | — | — |
| 17 × 17 mm fine grains (index ≧ 10) | Average grain index (ASTM E112) | 4 | 5 | 7 | — | — |

It can be seen that the solvus temperature of the γ' phase rises; this imposes a higher and higher solution treatment temperature, which is deleterious, firstly because the grain size of the material which has undergone thermo-mechanical transformation tends to increase greatly and more and more rapidly with solution treatment temperature, and secondly because carbides are dissolved, liberating residual carbon, A=0.65%Nb+1.25% Ti+2.20% Al≧4.4 (castings B and C), combined with a second aging stage of practical industrial duration between 600° C. and 675° C., can further increase hardness, as can be deduced from Table 4 below which shows the results of mechanical tests carried out on castings A, B and C in optimized conditions.

TABLE 4

Mechanical characteristics of castings A, B and C in optimized conditions, in the form of square section bars

| Casting/ Products | Heat treatments S.Q. | Heat treatments D.A. | Hardness $HV_{30}$ | Room temperature tension Rm ($N/mm^2$) | Room temperature tension $R\rho o_{.2}$ ($N/mm^2$) | Room temperature tension E4d (%) | Room temperature tension Z (%) | Break impact KV (J) |
|---|---|---|---|---|---|---|---|---|
| A 17 × 17 mm forged | 1040° C./2 h | 750° C./4 h/ I.C. 25°/h to 620° C./8 h/Air | 320 | 1197 | 724 | 29.5 | 42 | 96 |
| | 1050° C./2 h | 760° C./4 h/ I.C. 40°/h to 620° C./8 h/Air | 350 | 1225 | 733 | 27 | 34 | 55 |
| B 17 × 17 mm forged | 1000° C./2 h | 750° C./4 h/ I.C. 25°/h to 620° C./8 h/Air | 312 | 1153 | 669 | 29 | 41 | 84 |
| | 1020° C./2 h | 750° C./8 h/ I.C. 40°/h to 620° C./8 h/Air | 315 | 1183 | 681 | 26.5 | 40 | 78 |
| C 17 × 17 mm forged | 980° C./2 h | 720° C./4 h/ I.C. 25°/h to 620° C./8 h/Air | 334 | 1168 | 754 | 29.5 | 48 | 118 |
| | | 750° C./4 h/ I.C. 25°/h to 620° C./8 h/Air | 355 | 1208 | 822 | 25.5 | 43 | 70 |
| | 1000° C./2 h | 730° C./4 h/ I.C. 40°/h to 620° C./8 h/Air | 330 | 1153 | 729 | 31 | 48 | 135 |
| E 45 × 45 mm forged | 1000° C./2 h | 730° C./4 h/ I.C. 40°/h to 620° C./8 h/Air | 285 | 1048 | 640 | 41 | 57 | 135 |

S.Q. = Dissolution + rapid quenching
D.A. = Double Aging with intermediate cooling (I.C)

In addition, double aging in two stages can be optimised using a single heat treatment which comprises a first aging stage between 700° C. and 760° C., and slow cooling to the temperature of the second stage which is then maintained for the second aging stage. This cycle, which produces the desired hardening, is particularly suitable for large pieces where the cooling kinetics are slow. So far as the inventors are aware, this process constitutes the best way of carrying out the invention.

However, increasing addition of the highly segregating element niobium results in ingots of the alloy of the invention (even if they are alloyed with a small amount of molybdenum, another highly segregating element), and in the formation of an increasing quantity of Laves phases at the end of the solidification step, combined with the element iron. In addition to a reduction in the burn temperature of ingots by liquation of these Laves phases which are rich in niobium and iron, their forgeability is drastically degraded at the top of the usual range of mechanical transformation operations, as shown by the hot forgeability tensile tests carried out on castings A, B, C and D in a molded or homogenised condition (tension at 1200° C., $\dot{\epsilon}$=6.5 $s^{-1}$), the results of which are shown in Table 5 below.

TABLE 5

Hot forgeability tensile tests on castings in molded and homogenised condition (tension at 1200° C., $\epsilon$ = 6.5 $s^{-1}$)

| Homogenisation | Characteristics | Castings A | Castings B | Castings C | Castings D | Castings F |
|---|---|---|---|---|---|---|
| 1200° C. | Rm ($N/mm^2$) | 210 | 200 | 190 | 185 | <10 |
| for | E (%) | 61 | 57 | 39 | 7 | 0 |
| 16 h | Z (%) | 51 | 61 | 44 | 5 | 0 |
| 1250° C. | Rm ($N/mm^2$) | — | — | 196 | — | 216 |
| for | E (%) | — | — | 55 | — | 7 |
| 16 h | Z (%) | — | — | 53 | — | 10 |

It also becomes impossible to obtain satisfactory homogenisation of the segregated elements at low temperatures, below the burn temperature.

In casting example D for which the sum of the hardening elements A=0.65% Nb and 1.25% Ti+2.20% Al is limited to the minimum theoretical value of 4.4 necessary for the desired hardening, the 3.74% niobium content already causes unacceptable segregation in the small 35 kg ingot and greatly affects its forgeability at 1200° C.: the products are very sensitive to heat cracking while the forgeability range is limited to less than 1150° C.

In contrast, alloy G, for example, as claimed in our invention, remains forgeable up to 1235° C. as is shown by the results of hot forgeability tensile tests on forged semi-finished products shown in Table 6 below.

TABLE 6

Hot forgeability tensile tests on forged semi-finished products from industrial castings G and J

| Test | Casting G | | | | Casting J | |
|---|---|---|---|---|---|---|
| | Strain rate $\epsilon = 0.15\ s^{-1}$ | | Strain rate $\epsilon = 6.5\ s^{-1}$ | | Strain rate $\epsilon = 6.5\ s^{-1}$ | |
| temperature (° C.) | Rm ($N/mm^2$) | E (%) | Rm ($N/mm^2$) | E (%) | Rm ($N/mm^2$) | E (%) |
| 900 | 396 | 54 | 438 | 43 | — | — |
| 950 | 325 | 70 | 425 | 42 | — | — |
| 1050 | 207 | 85 | 370 | 64 | — | — |
| 1100 | 160 | 98 | 313 | 67 | — | — |
| 1150 | 122 | 98 | — | — | 260 | 73 |
| 1170 | — | — | 240 | 63 | — | — |
| 1180 | — | — | — | — | 228 | 58 |
| 1200 | 94 | 92 | 215 | 39 | 213 | 50 |
| 1225 | — | — | 187 | 4 | 170 | 2 |
| 1235 | 24 | 31 | — | — | — | — |
| 1250 | — | — | 5 | 0 | — | — |

As a sequence, the niobium content in the alloys of the invention is limited to 3.50%, preferably to 3.25%.

Provide that the contents of hardening elements as indicated above are satisfied, the alloy of the invention is characterized by a low solvus temperature of the hardening phases, of the order of 1000° C., by a wide homogenisation range, up to 1250° C., and by a disordered solid solution which is metastable, but sufficiently stable on cooling from temperatures above the solvus of γ', to satisfy two essential aims on application to large pieces:

the absence of disordered hardening precipitation on cooling from the solid solution region means that all of the hardening potential on aging can be retained with sufficient homogeneity in large pieces;

after forging at a temperature above the solvus of the hardening phases, the metal does not harden during cooling, and thus remains very ductile, which allows a variety of cooling modes to be used without risking quench cracking.

In certain cases with pieces of limited dimensions, the alloy of the invention can be aged directly after thermomechanical transformation, so as to obtain high strengths, while preserving good ductility as shown by mechanical tests carried out on a variety of forged or rolled products from industrial castings G to K of the invention, the results of which are shown in Table 7 below.

TABLE 7

Mechanical tests on forged or rolled products from castings G to K

| Casting/Products | | | Room temperature tension | | | | Break impact |
|---|---|---|---|---|---|---|---|
| Hardness in | Heat treatments | | Rm | $R\rho_{0.2}$ | E4d | Z | at 20° C. |
| unfinished condition | S.Q. | D.A. | ($N/mm^2$) | ($N/mm^2$) | (%) | (%) | KV (J) |
| Casting G ½ product square section 250 × 160 mm forged at 1160° C. (250 $HV_{30}$) | None | 750° C/4 h/ I.C. 25°/h to 620° C/8 h/Air | 1254 | 1014 | 18.1 | 39 | — |
| Casting G ½ product square section 250 × 160 mm forged at 1160° C. (250 $HV_{30}$) | 980° C./2 h | 750° C./4 h/ I.C. 25°/h to 620° C./8 h/Air | 1148 | 703 | 30 | 43 | — |
| Casting G ½ product square section 250 × 160 mm forged at 1010° C. (280 $HV_{30}$) | None | 750° C./4 h/ I.C. 25°/h to 620° C./8 h/Air | 1285 | 1035 | 18.7 | 36 | — |
| Casting G ½ product square section 250 × 160 mm forged at 1010° C. (280 $HV_{30}$) | 980° C./2 h | 750° C/4 h/ I.C. 25°/h to 620° C./8 h/Air | 1139 | 721 | 34 | 46 | — |
| Casting G "DN 32" valve drop forged at 1100° C. (200 $HV_{30}$) | None | 715° C./4 h/ I.C. 25°/h to 620° C/10 h/Air | 1152 | 811 | 31 | 42 | 106 |
| Casting G | 975° C./6 h | 745° C./4 h/ | 1149 | 768 | 31 .5 | 47 | 65 |

TABLE 7-continued

Mechanical tests on forged or rolled products from castings G to K

| Casting/Products | | | Room temperature tension | | | | Break impact |
|---|---|---|---|---|---|---|---|
| Hardness in | Heat treatments | | Rm | $R\rho_{0.2}$ | E4d | Z | at 20° C. |
| unfinished condition | S.Q. | D.A. | ($N/mm^2$) | ($N/mm^2$) | (%) | (%) | KV (J) |
| "DN 32" valve drop forged at 1100° C. (200 $HV_{30}$) | | I.C. 25°/h to 620° C./10 h/Air | | | | | |
| Casting G | None | 715° C./4 h/ | 1131 | 776 | 33.5 | 49 | 89 |
| "DN 32" valve drop forged at 1030° C. (220 $HV_{30}$) | | I.C. 25°/h to 620° C./10 h/Air | 1218 | 899 | 29 | 47 | 103 |
| Casting G | 975° C./6 h | 745°C./4 h/ | 1150 | 768 | 26.5 | 47 | 65 |
| "DN 32" valve drop forged at 1030° C. (220 $HV_{30}$) | | I.C 25°/h to 620° C./10 h/Air | 1119 | 695 | 34.5 | 46 | 67 |
| Casting G Ø 55 mm bar rolled at 1160° C. (235 $HV_{30}$) | None | 720° C./4 h/ I.C. 25°/h to 620° C./6 h/Air | 1248 | 846 | 31 | 44 | 47 |
| Casting G Ø 55 mm bar rolled at 1160° C. (235 $HV_{30}$) | 975° C./2 h | 740° C./4 h/ I.C. 25°/h to 620° C./10 h/Air | 1200 | 805 | 28 | 41 | 44 |
| Casting H ½ product square section 250 × 160 mm forged at 1160° C. (265 $HV_{30}$) | 980° C./2 h | 750° C./4 h/ I.C. 25°/h to 620° C./8 h/Air | 1122 | 714 | 32 | 28 | 29 |
| Casting H "DN 32" valve drop forged at 1100° C. | 975° C./6 h | 745° C./4 h/ i.C. 25°/h to 620° C./12 h/Air | 912 | 701 | 14 | 19 | 22 |
| Casting H "DN 32" valve drop forged at 1030° C. | 1015° C./6 h | 745° C./4h/ I.C. 25°/h to 620° C./12 h/Air | 1074 | 721 | 36 | 41 | 111 |
| | | | 1079 | 649 | 36 | 42 | 97 |
| Casting J 2" valve drop forged at 1160° C. | 1000° C./4 h | 750° C./6 h/ I.C. 40°/h to 620° C.12 h/Air | 1118 | 802 | 20.5 | 21 | 59 |
| Casting J forged bar Ø 245 mm | 990° C./5 h | 750° C./6h/ I.C. 40°/h to 620° C./12 h/Air | 1146 | 797 | 31 | 40 | 77 |
| Casting J forged bar Ø 145 mm | 990° C./5 h | 750° C./8 h/ I.C. 40°/h to 620° C./12 h/Air | 1162 | 782 | 32.5 | 42 | 71 |
| Casting J bar Ø 20 mm rolled | 990° C./1 h | 750° C./4 h/ I.C. 40°/h to 620° C./2 h/Air | 1215 | 776 | 33.5 | 47 | 54 |
| Casting K well head drop forged | 1010° C./9 h | 740° C./6 h/ I.C. 40°/h to 620° C./12 h/Air | 1032 | 700 | 33 | 38 | 96 |
| Casting K bar Ø 20 mm rolled | 990° C./1 h | 750° C/4 h/ I.C. 40°/h to 620° C./12 h/Air | 1202 | 744 | 34.5 | 49 | 64 |
| Casting I well head drop forged at 1160° C. | 1000° C/9 h | 750° C./6 h/ IC. 40° /h to 620° C./12 h/Air | 1016 | 750 | 20 | 24 | 75 |
| | | | 1036 | 763 | 20.5 | 27 | 78 |
| Casting I 2" valve drop forged at 1160° C. | 1000° C./4 h | 750° C./6 h/ I.C. 40°/h to 620° C./12 h/Air | 1074 | 769 | 31.5 | 33 | 106 |
| Casting I forged bar Ø 245 mm | 990° C./5 h | 750° C./6 h/ I.C. 40°/h to 620° C./12 h/Air | 1118 | 742 | 32.5 | 34 | 89 |
| Casting I forged bar Ø 145 mm | 990° C./5 h | 750° C./6 h/ I.C. 40°/h to 620° C./12 h/Air | 1135 | 726 | 34 | 41 | 88 |
| Casting I bar Ø 20 mm rolled at 1160° C. | 990° C./1 h | 750° C/4 h/ I.C. 40°/h to 620° C./12 h/Air | 1182 | 735 | 34.5 | 47 | 78 |

S.Q. = solution treated + rapid quenching
D.A = Double aging with intermediate cooling (I. C)

Having set the conditions which must be satisfied by the hardening elements titanium, aluminum, and niobium in the claimed alloy, we define the relationship which takes all of the elements of the alloy into account and which represents the character of each concerning its tendency to form harmful intermetallic phases. The relationship is as follows:

$$X=2.271\%\ Ti+1.142\%\ Cr+0.957\%\ Mn+0.858\%\ Fe+0.777\%\ Co+0.717\%\ Ni+2.117\%\ Nb+1.550\%\ Mo+1.655\%\ W+1.90\%\ Al+1.90\%\ Si+0.615\%\ Cu,\ \text{in atomic }\%.$$

This formula has been defined in order to predict the tendency of alloys to precipitate the sigma phase as a function of the value of X.

In the context of the present invention in order to guarantee the absence of the sigma phase, the value X in the above relationship as applied to the residual composition of the austenitic matrix of the claimed alloys, after aging which consumes the elements Ni, Ti, Al and Nb by precipitating the γ' and γ" phases, must remain below 91.5.

Calculation based on empirical observations allows us to evaluate the composition of the matrix of an aged superalloy. All of castings A to K shown in Table 1 were balanced such that their aged matrix, enriched in chromium, molybdenum, iron, and copper, satisfied the relationship $X<91.5$.

An essential characteristic of the present invention is thus that, if the relationship above, applied to the overall composition of the alloy before aging, gives a value of $X\leqq 93.5$ (taking into account inevitable minor segregation in large ingots), this alloy will not give rise to sigma phase precipitation during industrial aging cycles between 600° C. and 900° C. The industrial castings G to K of Table 1 satisfy this limit.

It can be seen that ingots of alloys of the invention, which all contain a certain fraction of Laves phase and/or sigma phase at the end of solidification, can be totally re-homogenised at a very high temperature to a single austenitic phase when their overall composition satisfies $X\leqq 93.5$.

Copper appears to be a determining element in this respect since, of all of the elements in the above relationship, it is the element with the smallest coefficient, which means it has a very low tendency to form the sigma phase: in this, it counter-balances the strong ability of other elements of the alloy to stabilise this phase.

The concentrations of each of the alloying elements can thus be selected as a function of their own effects:

The chromium content is in the range 20.5% to 22.5%, giving the alloy good general corrosion resistance in a variety of environments.

Molybdenum is the element which results in the best corrosion resistance in acidic reducing environments containing chlorides and the gases $H_2S$ and $CO_2$. However, its content is limited to between 5.5% and 7% in the alloy claimed, firstly because molybdenum strongly encourages sigma phase formation; and age hardening, which precipitates the γ' $Ni_3(Ti,Al)$ and γ" $Ni_3Nb$ phases, depletes the aged matrix in nickel, titanium, aluminum, and niobium and, as a consequence, enriches it in molybdenum in particular. Secondly, these contents are sufficient for the material to be resistant in oil industry environments, as the results of slow strain rate or constant load NACE tensile tests show in Tables 8, 9 and 10 below.

TABLE 8

SSC (Sulfide Stress Corrosion) test in accordance with NACE recommendation TM 0177-90-Method A
Conditions: Constant load tensile test, suspended in standard de-oxygenated medium,
at temperature of 23 ± 3° C., for a strain of 100% of the yield strength $R_{\rho 0.2}$

| | | Mechanical characteristics | | | | | Free corrosion | | | Corrosion by coupling with a steel | | |
|---|---|---|---|---|---|---|---|---|---|---|---|---|
| Casting product | Condition | Rm (N/mm²) | $R\rho_{0.2}$ (N/mm²) | $E_{4d}$ (%) | Z (%) | Hardness (RCH) | Solution (pH) Start | Solution (pH) End | Result (3 tests of 720 h) | Solution (pH) Start | Solution (pH) End | Result (3 tests of 720 h) |
| I bar Ø 20 mm | 990° C./1 h + 750° C./4 h/ I.C. 40° C./h to 620° C./ 12 h/Air | 1182 | 735 | 34.5 | 47 | 35.1 | 2.8 | 2.9 | 3 non-ruptures no SSC | 2.8 | 3.7 | 3 non-ruptures no SSC |
| J bar Ø 20 mm | | 1215 | 776 | 33.5 | 47 | 35.8 | 2.8 | 2.9 | 3 non-ruptures no SSC | 2.8 | 3.8 | 3 non-ruptures no SSC |
| K bar Ø 20 mm | | 1202 | 744 | 34.5 | 49 | 35 | 2.8 | 2.9 | 3 non-ruptures no SSC | 2.8 | 3.8 | 3 non-ruptures no SSC |

TABLE 9

SSC (Sulfide Stress Corrosion) test in accordance with NACE recommendation TM 0177-90-Method C
Conditions: Constant load test with C-ring test pieces in standard de-oxygenated medium, at temperature of 23° C. corrosion for 720 h

| | | Mechanical characteristics | | | | | | |
|---|---|---|---|---|---|---|---|---|
| Casting/product | Condition | Rm ($N/mm^2$) | $R_{p0.2}$ ($N/mm^2$) | $E_{4d}$ (%) | Z (%) | Hardness RCH | Applied stress ($N/mm^2$) | Result (two 720 h tests) |
| Casting G Bar Ø 55 mm | 975° C./2 h + 740° C./4 h/I.C. 25°/h to 620° C./10 h/Air | 1200 | 805 | 28 | 41 | 35.6 | 710 ($R_{p0.02}$) | 2 non ruptures |
| Rolled | 720° C./4 h/ I.C. 25°/h to 620° C./6 h/Air | 1248 | 846 | 31 | 44 | 38 | 820 ($R_{p0.02}$) | 2 non ruptures |
| Casting J 2" valve | 1000° C./4 h + 750° C./6 h/I.C. 40°/h | 1118 | 802 | 21 | 21 | — | 802 ($R_{p0.2}$) | 2 non ruptures |
| Casting I 2" valve | to 620° C./12 h/Air | 1074 | 769 | 31.5 | 33 | — | 769 ($R_{p0.2}$) | 2 non ruptures |

20

TABLE 10

Slow strain rate tensile test
SSRT (Slow Strain Rate Tensile) in accordance with NACE recommendation
(SSRT for SCC in Sour Oilfield Service)
Test in Level VI medium of Nace MR 0175 (Table I) at 175° C.
and a strain rate of $4 \times 10^{-6}$ $s^{-1}$:
Partial pressure of $H_2S$: 3.5 MPa (508 psia)
Partial pressure of $CO_2$: 3.5 MPa (508 psia)
Total pressure: 8.2 MPa (1185 psia)
NaCl concentration: 20% by weight

| | | SSR in air at 175° C. | | | SSR in medium | | | | | | |
|---|---|---|---|---|---|---|---|---|---|---|---|
| | | Time to | | | Time to | | | Sensitivity indices | | | |
| Casting/product | Condition | break TTF (h) | E (%) | Z (%) | break TTF (h) | E (%) | Z (%) | TTF TTFalr | E E air | Z Z air | Remarks |
| I Ø 20 mm bar 35.1 RCH | 990° C./1 h + 750° C./4 h | 26.3 | 36 | 43 | 26.2 | 36 | 35 | 1.0 | 1.0 | 0.80 | no SCC |
| | | | | | 27.0 | 36 | 35 | 1.03 | 1.0 | 0.80 | " |
| J Ø 20 mm bar 35.8 RCH | I.C. 40°/h/to 820° C./12 h/Air | 24.7 | 34 | 41 | 26.3 | 36 | 37 | 1.0 | 1.0 | 0.84 | " |
| | | | | | 24.4 | 33 | 33 | 0.92 | 0.92 | 0.75 | " |
| K Ø 20 mm bar 35.0 RCH | | 27.5 | 38 | 49 | 25.2 | 34 | 33 | 0.94 | 0.94 | 0.75 | " |
| | | | | | 25.6 | 34 | 33 | 0.94 | 0.94 | 0.75 | " |

With 7% of molybdenum in the alloy, the aged matrix can contain up to 8.0% of that element, which is sufficient.

Pitting corrosion resistance is gradually improved with the % of molybdenum as shown by tests for determining the pitting temperatures carried out on forged or rolled products from castings A, B, C, E, G, H, I and K using two conventional tests, the ASTM G48 test and the "Green Death" test.

ASTM G48 Pitting Corrosion Test

The pitting temperature was determined in an aqueous medium containing 10% by weight of crystallised iron perchloride ($FeCl_3$-$6H_2O$), using parallelipipedal test pieces polished with SiC paper under water (120 grade), using the following methodology:

a succession of several immersion periods of 72 h at increasing temperatures;

the test temperature was increased by 5° C. after an immersion period of 72 h; the test pieces were re-polished for each new exposure.

"Green Death" Pitting Corrosion Test

The pitting temperature was determined in an aqueous medium constituted by:

11.5% $H_2SO_4$-1.2% HCl - 1% $FeCl_3$- 1% $CuCl_2$ (% by weight) (or 7% by volume $H_2SO_4$, 3% by volume HCl, 1% by weight $FeCl_3$, 1% by weight $CuCl_2$) using parallelipipedal test pieces polished with SiC paper under water (120 grade) using the following methodology:

a succession of several immersion periods of 96 h at increasing temperatures;

the temperature was increased by 5° C. after an immersion period of 96 h; the test pieces were re-polished for each new exposure.

The results of these two tests are shown in Table 11 below:

TABLE 11

Pitting corrosion resistance of forged or rolled products in two representative media

| Castings/ Products | Condition: Solution treated | Condition: Aging | ASTM G48A test | <<Green Death >> test | Y = % Mo + % W +% Cu/ % Mo |
|---|---|---|---|---|---|
| A square section 45 × 45 mm | 1050° C./2 h | 760° C./4 h i.C. 40°C./h to 620° C./8 h/air | — | <50° C. | 6.69/ 5.52 |
| B square section 45 × 45 mm | 1020° C./2 h | 750° C./8 h i.C. 40° C./h to 620° C/8 h/air | — | <50° C. | 6.69/ 5.51 |
| C square section 45 × 45 mm | 1000° C./2 h | 730° C./4 h I.C. 40° C./h to 620° C./8 h/air | — | ≈50° C. | 6.68/ 5.53 |
| G Ø 55 mm | none | 720° C./4 h I.C. 25° C./h to 620° C./6 h/air 740° C./4 h | 65–75 | 60–70 | 7.07/ 5.77 |
| | 975° C./2 h | I.C. 25° C./h to 620° C./10 h/air | 65–75 | 60–70 | |
| E square section 45 × 45 mm | 1000° C./2 h | 730° C./4 h I.C. 40° C./h to 620° C/8 h/air | — | 65 | 10.49/ 5.64 |
| H | 975° C./6 h | 745° C/4 h I.C. 25° C./h to 620° C./12 h/air | 85 | 75 | 7.96/ 6.63 |
| DN 32 valves | 1015° C./6 h | 745° C./4 h I.C. 25° C./h to 620° C./12 h/air | | | |
| I drop forged well head | 1000° C./9 h | 750° C./6 h I.C. 40° C./h to 620° C./12 h/air | 80 | 75 | 7.28/ 5.92 |
| K drop forged well head | 1010° C./9 h | 740° C./6 h I.C. 40° C./h to 620° C./12 h/air | 90 | 85 | 7.99/ 6.59 |

Addition of copper is favorable for the reasons described above: in contrast, tertiary Ni—Cr—Cu and Ni—Mo—Cu phase diagrams include regions of immiscibility for low copper contents, which are extensions of regions of immiscibility in binary Cr—Cu and Mo—Cu systems, which are also observed in the Fe—Cu system.

In addition, pseudo-binary eutectics of low melting point exist in the Ni—Ti—Cu system: as a result, copper addition must be strictly controlled in Ni—Cr—Fe—Mo—Ti alloys, in particular those which are rich in molybdenum, if forgeability is to be retained. As an example, it can be seen from Table 5 above that the alloy of casting F which contains 6.5% of molybdenum and 4% of copper (not in accordance with the invention) has very greatly degraded behavior during thermo-mechanical rough forging of ingots, probably due to partial liquification of the boundaries of segregated grains; deep homogenisation of the ingot improves this behavior, but not sufficiently. The alloy of the invention thus claims a maximum copper content of 3.5% in its broadest composition, preferably limited to 2.5%, in the case of severe thermo-mechanical transformation (rolling), and such that $\% Mo + \% Cu + \% W \leqq 9\%$ by weight.

Iron is not an element which is essential to the properties of the alloy, but this element is considered to improve the tolerance of nickel based alloys to hydrogen and is inexpensive. In contrast, in combination with niobium and silicon, iron increases the formation of unwanted Laves phases. For these reasons, its content in the alloy is limited to between 7% and 13%.

The addition of cobalt is not necessary to the alloy of the invention but a residual content of up to 3% can be tolerated so as to allow recycling of materials containing cobalt.

Tungsten is an element which, to a lesser extent than molybdenum, encourages corrosion resistance in reducing environments. However, this element induces a solid solution hardening effect which is marked at high temperatures: this effect can be seen for casting E which contains 2.6% of W substituting for iron, and for which heat hardening has rendered forgeability very difficult (see Table 3). As a result, tungsten content is limited to 0.5% in the alloy of the invention, with the aim of accepting raw materials which may contain it; preferably, however, its addition is not desirable.

The residual element contents are strictly controlled in the following cases:

Silicon, which is always found in trace amounts in nickel based alloys, is a particularly harmful element in several respects: it has a strong tendency to form intermetallic phases, among them the sigma phase, Laves phases, and titanium silicides in the alloys of the invention, whether they are ingots at the end of solidification with its strong tendency to segregate or whether during age hardening where it can also give rise to the formation of $Ni_3Si$ type phases which are unwanted within the context of the present invention. The silicon content in the alloy which is claimed is thus limited to 0.2%.

Magnesium is a deoxidising element which can be included in small quantities on production; in some cases this element has a beneficial effect on forgeability of nickel based alloys by a particular action which cannot be clearly explained. In the alloy which is claimed, magnesium addition is not necessary and the residual content of this element is at most 0.005%, which means that its deoxidation properties can be used if necessary.

Phosphorous and sulfur in particular are impurities which are considered to be extremely harmful to the alloy as they strongly affect the behavior of the metal on forging and encourage hydrogen embrittlement. These two elements are thus limited to very low contents, i.e., S≦0.0050% and P≦0.0300% and, preferably, S≦0.0020% and P≦0.0100% when better thermomechanical transformation behavior is desired.

Given the low solubility of nitrogen in austenitic nickel based alloys and the high reactivity of this element with titanium, the nitrogen content is limited to a maximum of 0.020%, well within its theoretical solubility in the liquid metal of the claimed alloy, which is about 0.15% to 0.20%: this necessitates vacuum production means.

The alloy of the invention can be produced and transformed using known techniques which are in current use for the commercial production of nickel based alloys. Production under vacuum is necessary in order to prepare an electrode with low gas contents and a very low carbon content, which is then remelted so as to obtain an alloy of the required quality. The alloy is readily heat transformable using conventional thermo-mechanical transformation techniques following very high temperature homogenisation treatment at temperatures which do not exceed 1250° C.

The thermo-mechanical transformations are carried out after solution treatment/reheating in a temperature range which is in the range 975° C. to 1175° C.

However, low pre-heating temperatures, which then require high energy during transformations, are reserved for specific applications where grain size growth is to be avoided, such as final drop forging of pieces of average to small dimensions.

In all cases, the temperature at the end of the thermo-mechanical transformation step must be over 950° C. if the better malleability of the alloy is to be available.

The low solvus temperatures of the hardening phases of this alloy, 950° C. to about 1025° C., allow low dissolution temperatures to be used, which is advantageous since they limit the effect of abrupt grain size growth as encountered at higher temperatures.

However, these low dissolution temperatures compete to limit the rate of carbide dissolution, which attenuates the rate of intergranular reprecipitation of carbide which are harmful for subsequent aging.

Ingots of industrial castings G to K were transformed into a variety of products using the above precepts. The tables above show the mechanical characteristics obtained with the alloys of the invention. Tables 12 and 13 below more particularly concern tests on products from casting G.

TABLE 12

Characteristics of a Ø 30 mm rolled bar as a function of different cold drawing rates - Casting G solution treated for 1 hour at 980° C.

| Draw rate | Mechanical characteristics in drawn condition Tensile test at 20° C. | | | | Mechanical characteristics in drawn and aged condition (D.A) Tensile test at 20° C. | | | |
|---|---|---|---|---|---|---|---|---|
| L/Lo | $R_m$ (N/mm²) | $R\rho_{0.2}$ (N/mm²) | $E_{5d}$ (%) | Z (%) | $R_m$ (N/mm²) | $R\rho_{0.2}$ (N/mm²) | $E_{5d}$ (%) | Z (%) |
| 1.0 | 866 | 411 | 46 | 69 | 1230 | 824 | 27.5 | 55 |
| 1.15 | 1013 | 713 | 34 | 65 | 1361 | 1162 | 21.5 | 48 |
| 1.23 | 1101 | 886 | 27 | 62 | 1451 | 1302 | 17.5 | 48 |
| 1.31 | 1183 | 1006 | 16.5 | 60 | 1531 | 1426 | 12.5 | 40 |
| 1.41 | 1281 | 1124 | 14 | 55 | 1601 | 1520 | 8.5 | 40 |

D.A = Double aging; 720° C./4 h/I.C. 50°/h → 620° C./8 h/Air

Table 13 Mechanical Characteristics of Hot Rolled Products

Casting G, rolled Ø55 mm products at 1160° C., solution treated-rapidly quenched at 975° C./2 h and aged as follows: 740° C./4h/I.C. 25° C./h to 620° C./10 h/air

| Test temperature (° C.) | Tension characteristics $R_m$ (N/mm²) | $R\rho_{0.2}$ (N/mm²) | $E_{4d}$ (%) | Z (%) |
|---|---|---|---|---|
| 20 | 1200 | 805 | 28 | 41 |
| 250 | 1168 | 789 | 31.5 | 49 |
| 550 | 1116 | 795 | 29 | 42 |
| 600 | 1130 | 776 | 30 | 46 |

Despite a gradual reduction in ductility in the core of the pieces when their dimensions increased, the values were acceptable in the case of well heads of up to 2.5 tonnes, drop forged in one pressing from a parallelipipedal semi-finished product. The strength characteristics were retained up to 550° C., well beyond the service range in oil industry environments.

Clearly, the different implementations of the process of the invention which have been described have been given by way of purely illustrative and non limiting example only, and that a number of modifications can readily be made by the skilled person without departing from the ambit of the invention.

I claim:

1. Precipitation hardened alloy compositions consisting essentially of the following elements, with the contents expressed in % by weight:

| | |
|---|---|
| nickel: | ≧52.00% |
| chromium: | 20.50%–22.50% |
| iron: | 7.00%–13.00% |
| molybdenum: | 5.50%–7.0% |
| copper: | 1.00%–3.50% |
| niobium: | 2.65%–3.50% |
| titanium: | 1.0%–2.0% |
| cobalt: | 0–3.00% |
| aluminum: | 0–0.75% |
| tungsten: | 0–0.50% |
| silicon: | 0–0.20% |
| manganese: | 0–0.20% |
| phosphorous: | 0–0.03% |
| carbon: | 0–0.02% |
| nitrogen: | 0–0.02% |

-continued

| | |
|---|---|
| magnesium: | 0–0.005% |
| sulfur: | 0–0.005% |

said elements satisfying the following four relationships:

X=(2.271% Ti+1.142% Cr+0.957% Mn+0.858% Fe+0.777% Co+0.717% Ni+2.117% Nb+1.550% Mo+1.655% W++1.90% Al+1.90% Si+0.615% Cu)≦93.5, the percentages for this relationship being in atomic %;

Y=(% Mo+% W+% Cu)≦9, the percentages for this relationship being in % by weight;

A=(0.65% Nb+1.25% Ti+2.20% Al)≧4.4, the percentages for this relationship being in % by weight;

$$\bullet\ B = \left(\frac{1.25\%\ Ti + 2.20\%\ Al}{0.65\%\ Nb}\right) \geq 0.80,$$

the percentages for this relationship being in % by weight.

2. Alloy compositions according to claim 1, comprising 0 to 0.015% by weight of carbon.

3. Alloy compositions according to claim 1, comprising 0.4% to 0.6% by weight of aluminum.

4. Alloy compositions according to claim 1, comprising 2.65 to 3.25% by weight of niobium.

5. Alloy compositions according to claim 1, comprising 1.0 to 2.5% by weight of copper.

6. Alloy compositions according to claim 1, comprising 0 to 0.002% by weight of sulfur.

7. Alloy compositions according to claim 1, comprising 0 to 0.01% by weight of phosphorous.

8. Pieces constituted by an alloy according to claim 1.

9. An article of manufacture for use in the oil industry comprising the alloy of claim 1.

10. An article of manufacture for use in the oil industry comprising the alloy of claim 8.

* * * * *

UNITED STATES PATENT AND TRADEMARK OFFICE

CERTIFICATE OF CORRECTION

PATENT NO. : 6,004,408

DATED : December 21, 1999

INVENTOR(S) : Jacques Montagnon

It is certified that error appears in the above-identified patent and that said Letters Patent is hereby corrected as shown below:

Column 26, cancel claims 8 and 10.

Signed and Sealed this

Sixteenth Day of May, 2000

*Attest:*

Q. TODD DICKINSON

*Attesting Officer*

*Director of Patents and Trademarks*